US010260849B2

(12) United States Patent
Piehler et al.

(10) Patent No.: US 10,260,849 B2
(45) Date of Patent: Apr. 16, 2019

(54) OFF-ON EXPLOSIVE WARHEAD FOR HIGH ENERGY FORMULATIONS WITH TAILORABLE OUTPUT PERFORMANCE

(71) Applicant: THE UNITED STATES OF AMERICA AS REPRESENTED BY THE SECRETARY OF THE ARMY—U.S. ARMY RESEARCH LABORATORY, Washington, DC (US)

(72) Inventors: Thuvan Piehler, Fallston, MD (US); Rohan Joel Banton, Bel Air, MD (US)

(73) Assignee: The United States of America as represented by the Secretary of the Army, Washington, DC (US)

( * ) Notice: Subject to any disclaimer, the term of this patent is extended or adjusted under 35 U.S.C. 154(b) by 199 days.

(21) Appl. No.: 15/464,747

(22) Filed: Mar. 21, 2017

(65) Prior Publication Data

US 2018/0274891 A1 Sep. 27, 2018

(51) Int. Cl.
*F41A 9/00* (2006.01)
*F42B 12/20* (2006.01)
*F42C 15/184* (2006.01)

(52) U.S. Cl.
CPC ..... *F42B 12/208* (2013.01); *F42C 15/184* (2013.01)

(58) Field of Classification Search
CPC ..... F42B 12/208; F42C 15/184
See application file for complete search history.

(56) References Cited

U.S. PATENT DOCUMENTS

| | | | | |
|---|---|---|---|---|
| 400,903 | A * | 4/1889 | Emmens | F42B 12/208 102/478 |
| 4,002,121 | A * | 1/1977 | Prochnow | F42B 12/48 102/364 |
| 5,542,354 | A | 8/1996 | Sigler | |
| 6,283,036 | B1 * | 9/2001 | Munsinger | F42B 12/204 102/475 |
| 6,536,351 | B2 * | 3/2003 | Bocker | F42B 12/22 102/478 |
| 8,943,971 | B1 * | 2/2015 | Sherlock | F42B 12/207 102/478 |
| 2008/0035005 | A1 * | 2/2008 | Veksler | F42B 12/208 102/393 |
| 2013/0042782 | A1 * | 2/2013 | Haskins | F42B 12/207 102/478 |

* cited by examiner

*Primary Examiner* — Gabriel J. Klein
(74) *Attorney, Agent, or Firm* — Robert Thompson

(57) ABSTRACT

A warhead includes a casing having a removable front portion, a plurality of explosive segments positioned in the casing, a plurality of spacers positioned in the casing and separating the plurality of explosive segments from each other, and a removable piston configured to be inserted inside the removable front portion of the casing, wherein the removable piston pushes against the plurality of explosive segments to create a continuous segment. The removable piston may push against the plurality of explosive segments to close the plurality of spacers and move the warhead from an off position to an on position. The continuous segment may be above an explosive failure thickness in the on position. The continuous segment may be configured to detonate upon reaching the failure thickness.

20 Claims, 6 Drawing Sheets

OFF-ON EXPLOSIVE WARHEAD FOR HIGH ENERGY FORMULATIONS WITH TAILORABLE OUTPUT PERFORMANCE

GOVERNMENT INTEREST

The embodiments herein may be manufactured, used, and/or licensed by or for the United States Government without the payment of royalties thereon.

BACKGROUND

Technical Field

The embodiments herein generally relate to munitions, and more particularly to warheads.

Description of the Related Art

There are various warhead designs used in military and commercial applications. Some conventional warhead designs make use of segmented warhead projectiles, such as those described in U.S. Pat. Nos. 5,542,354 and 6,536,351. In addition to the accuracy of the flight of the warhead, lethality is also a significant aspect of any warhead design. Most conventional designs typically do not account for the concept that an explosive will not reliably detonate below its critical thickness/diameter. Accordingly, there remains a need for a new warhead that accounts for this concept.

SUMMARY

In view of the foregoing, an embodiment herein provides a warhead comprising a casing; a plurality of explosive segments positioned in the casing; a plurality of spacers separating the plurality of explosive segments from each other; a removable nose cap positioned at a front portion of the casing; and a removable bias member configured to be positioned inside the casing, wherein the removable bias member pushes against the plurality of explosive segments to move the warhead from an off position to an on position. The removable nose cap may be positioned outside on the casing in the off position and the on position. The removable nose cap may be removed from the casing in a transition position between the off position and the on position. Each segment of the plurality of segments may be below an explosive failure thickness in the off position. The removable bias member compresses the plurality of explosive segments together creating a continuous segment and closing the plurality of spacers in the on position. The continuous segment may be above an explosive failure thickness in the on position. The compression of the plurality of explosive segments together causes detonation of the plurality of explosive segments. The removable bias member may comprise a piston. The piston may comprise a mechanical piston. The plurality of spacers may comprise any of an air gap, compressible foam, metal, a polymer, and an energetic binder material. The plurality of spacers may comprise an explosive material that is less energetically sensitive than the plurality of explosive segments. The plurality of explosive segments may be arranged in a stacked configuration.

Another embodiment provides a warhead comprising a casing comprising a removable front portion; a plurality of explosive segments positioned in the casing; a plurality of spacers positioned in the casing and separating the plurality of explosive segments from each other; and a removable piston configured to be inserted inside the removable front portion of the casing, wherein the removable piston pushes against the plurality of explosive segments to create a continuous segment. The removable piston may push against the plurality of explosive segments to close the plurality of spacers and move the warhead from an off position to an on position. The continuous segment may be above an explosive failure thickness in the on position. The continuous segment may be configured to detonate upon reaching the failure thickness.

These and other aspects of the embodiments herein will be better appreciated and understood when considered in conjunction with the following description and the accompanying drawings. It should be understood, however, that the following descriptions, while indicating preferred embodiments and numerous specific details thereof, are given by way of illustration and not of limitation. Many changes and modifications may be made within the scope of the embodiments herein without departing from the spirit thereof, and the embodiments herein include all such modifications.

BRIEF DESCRIPTION OF THE DRAWINGS

The embodiments herein will be better understood from the following detailed description with reference to the drawings, in which.

DETAILED DESCRIPTION

Figure 1A:
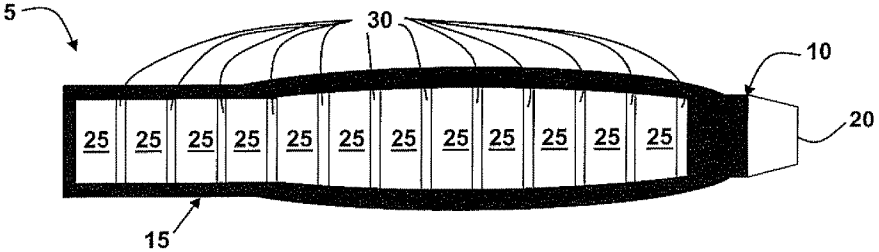
FIG. 1A illustrates a schematic diagram of a warhead in an off position according to the embodiment herein.

The embodiments herein and the various features and advantageous details thereof are explained more fully with reference to the non-limiting embodiments that are illustrated in the accompanying drawings and detailed in the following description. Descriptions of well-known components and processing techniques are omitted so as to not unnecessarily obscure the embodiments herein. The examples used herein are intended merely to facilitate an understanding of ways in which the embodiments herein may be practiced and to further enable those of skill in the art to practice the embodiments herein. Accordingly, the examples should not be construed as limiting the scope of the embodiments herein.

The warhead provided by the embodiments herein has filled explosive segments that have a thickness below critical failure thickness of an explosive and interleaved with metallic/plastic foam segments. Referring now to the drawings, and more particularly to FIGS. 1A through 5B, where similar reference characters denote corresponding features consistently throughout the figures, there are shown preferred embodiments.

Figure 1B:
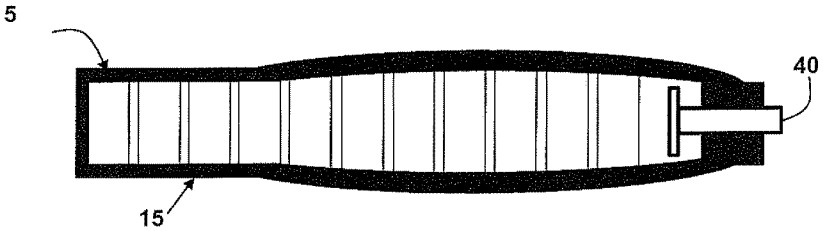
FIG. 1B illustrates a schematic diagram of a warhead in a transition position according to the embodiment herein.
Figure 1C:
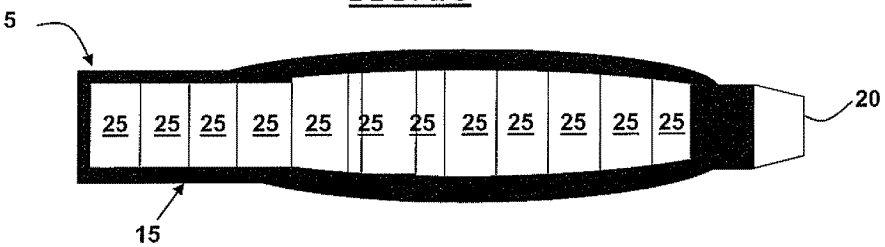
FIG. 1C illustrates a schematic diagram of a war head in an on position according to the embodiment herein.

The embodiments herein utilize explosive critical thickness combined with a gap in a munition to control the explosive performance in its "on" or ready state, as well as when the explosive is in its "off" or inactivate state. FIGS. 1A through 1C illustrate schematic diagrams of a warhead 5 in accordance with the embodiments herein. FIG. 1A illustrates the warhead 5 in an "off" position. FIG. 1B illustrates the warhead 5 in a "transition" position (i.e., transition between the "off" position and "on" position). FIG. 1C illustrates the warhead 5 in an "on" position. The warhead 5 comprises a casing 15, a plurality of explosive segments 25 positioned in the casing 15, a plurality of spacers 30 separating the plurality of explosive segments 25 from each other, a removable nose cap 20 positioned at a front portion 10 of the casing 15, and a piston 40 configured to be positioned in the casing 15 and removed after use, wherein actuation of the piston 40 moves the warhead 5 from an off position to an on position. The removable nose cap 20 is removed when the piston 40 is inserted and used to push the segments 25 together. The removable nose cap 20 can be reattached once the segments 25 have been pushed together and the piston 40 is removed. The explosive segments 25 are below the critical explosive thickness due to the presence of the spacers 30 separating the segments 25 from one another indicating the inactivated or "off" state of the warhead 5. The segments 25 and spaces 30 are placed into the half splitting casing 15. The spacers 30 may be configured as any of air gaps, super compressible foam strips, metal particles, energetic binders, and insensitive energetic materials. The pushing of the piston 40 against the plurality of segments 25 causes closure or removal of the spacers 30 and signifies the explosive readiness or "on" state of the warhead 5. The accurate knowledge of the critical thickness dimensions of explosives used in munitions is essential not only for safe handling but for the response to unplanned stimuli, as well as to maintain lethal performance. The warhead 5 is sufficiently insensitive yet powerful to maintain lethal performance through the addition of controlled spacers 30 and explosive critical thickness.

Figure 1D:
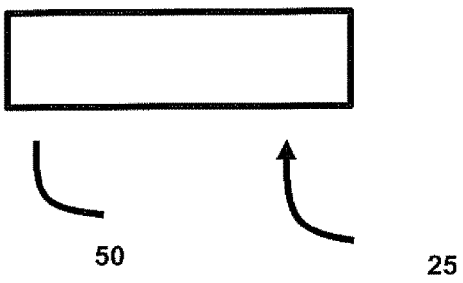
FIG. 1D is a schematic diagram illustrating a polymer case with explosive fill according to an embodiment herein.

Furthermore, the warhead 5 can be incorporated into existing inventory without sacrificing lethality. The explosive segments 25 and spacers 30 can be remade using 3-D printing technology and mass produced to fit mission need. The explosive main fill of the explosive segments 25 can be chosen from any existing inventory, and is surrounded by a polymer case 50, as shown in FIG. 1D.

As mentioned, the accurate knowledge of the critical thickness dimensions of explosives used in munitions is essential not only for safe handling but for the response to unplanned stimuli as well as performance. The concept of explosive critical thickness combined with spacers 30 in the warhead 5 controls the explosive performance in its "on" or ready state as well as in the inactivated or "off" state. The control approach of the warhead 5 is based on explosive theory which state that an explosive will not reliably detonate below its critical thickness. Therefore, knowledge of an explosive critical thickness combined with spacers 30 allows for the controlling of the warhead 5 for an "off-on" response.

Figure 2:
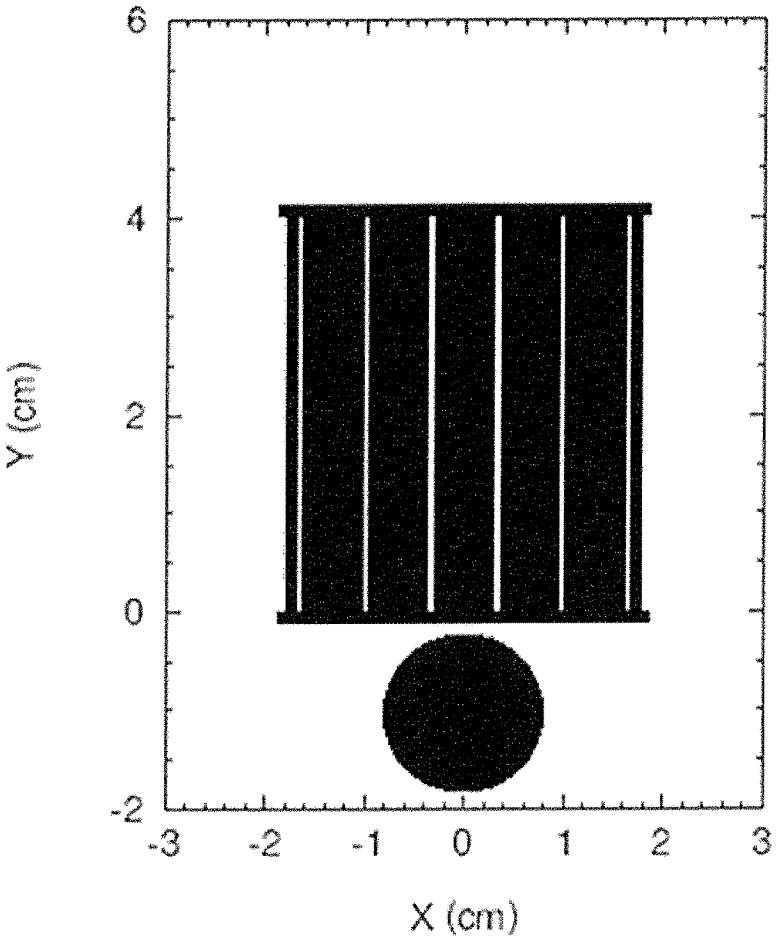
FIG. 2 illustrates the segmented portion of an "off-on" munition in its rest state being impacted by a spherical fragment in accordance with the embodiments herein.

FIG. 2, with reference to FIGS. 1A through 1D, shows the case of side impact into inactivated munition filled with strips of trinitrotoluene (TNT) explosives 6 mm thick. Each strip of TNT is separated by 0.6 mm air gaps. The strips of TNT and air gaps are confined within 1.2 mm thick steel wall to represent the munition casing 5. A spherical fragment impactor with diameter of 16 mm is used to represent the leading particle of an explosively formed penetrator (EFP). The speed of the spherical fragment that impacted the side of the munition case was 2.5 km/s.

Figures 3A, 3B:
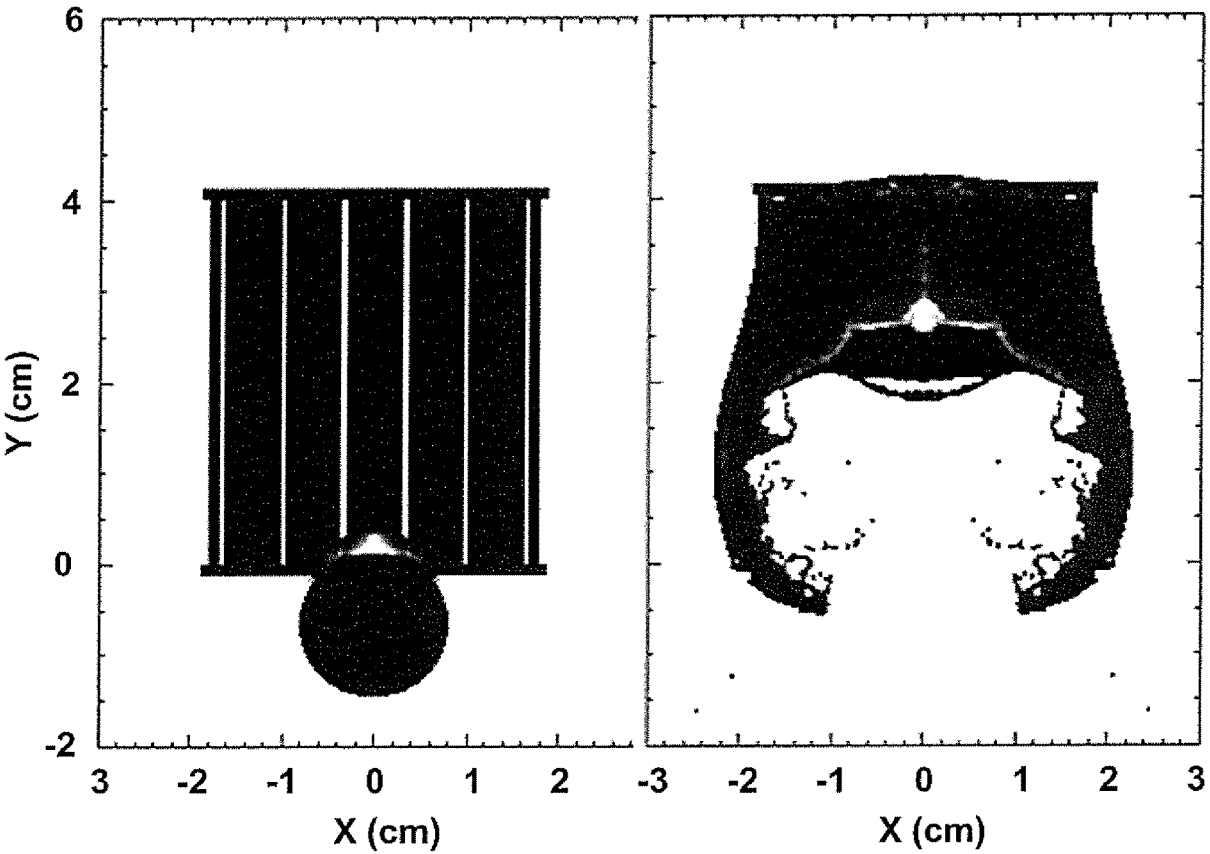
FIG. 3A illustrates an impact with initial reactivity with the embodiment hereins.
FIG. 3B illustrates detonation failure in munition in its rest "off" state in accordance with the embodiments herein.

FIG. 3A and FIG. 3B, with reference to FIGS. 1A through 2, show the simulated results into the side of the munition case. FIG. 3A illustrates an impact with initial reactivity, and FIG. 3B illustrates detonation failure in munition in its rest "off" state in accordance with the embodiments herein. The extent of the explosive reaction is captured in terms of a successful detonation indicated by the numerical value of one or a detonation failure represented by a value of zero. Based on the simulated results a detonation failure occurs. The munition package in this "off" configuration state fails to detonate primarily due to the fact that the thickness of the TNT strips used is below the 7 mm critical thickness for the explosive. In addition, the preliminary detonation propagation also failed due to the surrounding air gaps.

Figure 4:
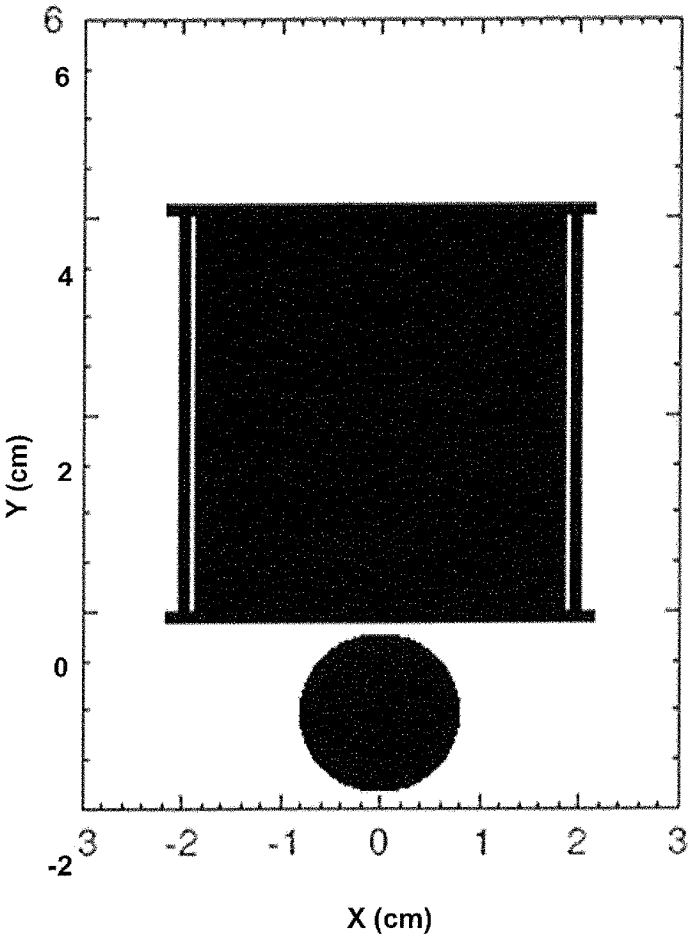
FIG. 4 illustrates the segmented portion of an "off-on" munition in its ready state being impacted by a spherical fragment in accordance with the embodiments herein.

FIG. 4, with reference to FIGS. 1A through 3B, shows the case of side impact into the activated or munition ready state. In this case the air gaps are squeezed out leaving perfect contact between the strips of TNT. Generally, the explosive in the munition ready state is treated as uniform and homogeneous without any breaks or gaps.

Figures 5A, 5B:
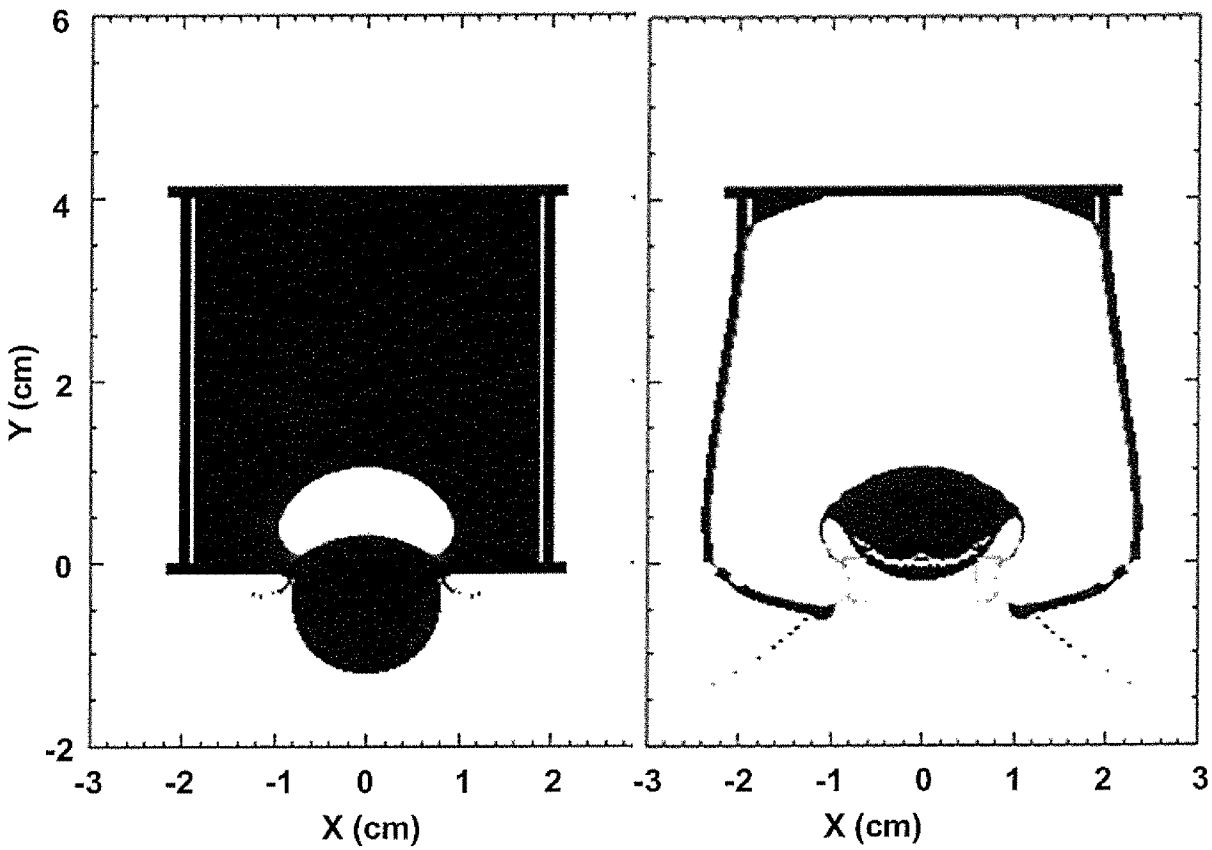
FIG. 5A illustrates an impact with initiation propagation to full detonation in accordance with the embodiments herein.
FIG. 5B illustrates the segmented portion of an "off-on" munition in its ready state showing successful detonation in accordance with the embodiments herein.

FIG. 5A and FIG. 5B, with reference to FIGS. 1A through 4, shows the successful detonation of the TNT explosive in the munition ready or "on" state. FIG. 5A illustrates an impact with initiation propagation to full detonation, and FIG. 5B illustrates the segmented portion of an "off-on" munition in its ready state showing successful detonation in accordance with the embodiments herein. By squeezing out the air gaps the explosive are in complete contact with each other. This enables the explosive thickness to rise above the 7 mm critical thickness dimension of the TNT explosive. Consequently, the detonation is able to propagate throughout the explosive unimpeded by airgaps. The detonation is deemed successful. The techniques provided by the embodiments herein may apply widely to a variety of existing munitions without the need for new explosive fills that both meet performance and satisfy insensitive munitions (IM) requirements.

The embodiments herein relate to detonation failure diameter and thickness of explosive mechanisms, and more particularly the embodiments herein provide a warhead 5 with an off-on explosive filled segments 25 that can be controlled with a mechanical or gas driven piston 40. In alternative embodiments, other types of bias members other than a piston 40 could be utilized, including spring members, etc. The off-on warhead 5 is sufficiently powerful to maintain lethality and can also be incorporated into existing inventory.

The foregoing description of the specific embodiments will so fully reveal the general nature of the embodiments herein that others can, by applying current knowledge, readily modify and/or adapt for various applications such specific embodiments without departing from the generic concept, and, therefore, such adaptations and modifications should and are intended to be comprehended within the meaning and range of equivalents of the disclosed embodiments. It is to be understood that the phraseology or terminology employed herein is for the purpose of description and not of limitation. Therefore, while the embodiments herein have been described in terms of preferred embodiments, those skilled in the art will recognize that the embodiments herein can be practiced with modification within the spirit and scope of the appended claims.

What is claimed is:

1. A warhead comprising:

a casing;

a plurality of explosive segments positioned in said casing;

a plurality of spacers separating said plurality of explosive segments from each other;

a removable nose cap positioned at a front portion of said casing; and a removable bias member configured to be positioned inside said casing, wherein said removable bias member pushes against said plurality of explosive segments to move said warhead from an off position to an on position.

2. The warhead of claim 1, wherein said removable nose cap is positioned outside on said casing in said off position and said on position.

3. The warhead of claim 1, wherein said removable nose cap is removed from said casing in a transition position between said off position and said on position.

4. The warhead of claim 1, wherein each segment of said plurality of segments is below an explosive failure thickness in said off position.

5. The warhead of claim 1, wherein said removable bias member compresses said plurality of explosive segments together creating a continuous segment and closing said plurality of spacers in said on position.

6. The warhead of claim 5, wherein said continuous segment is above an explosive failure thickness in said on position.

7. The warhead of claim 5, wherein the compression of said plurality of explosive segments together causes detonation of said plurality of explosive segments.

8. The warhead of claim 1, wherein said removable bias member comprises a piston.

9. The warhead of claim 8, wherein said piston comprises a mechanical piston.

10. The warhead of claim 1, wherein said plurality of spacers comprise an air gap.

11. The warhead of claim 1, wherein said plurality of spacers comprise compressible foam.

12. The warhead of claim 1, wherein said plurality of spacers comprise metal.

13. The warhead of claim 1, wherein said plurality of spacers comprise a polymer.

14. The warhead of claim 1, wherein said plurality of spacers comprise an energetic binder material.

15. The warhead of claim 1, wherein said plurality of spacers comprise an explosive material that is less energetically sensitive than said plurality of explosive segments.

16. The warhead of claim 1, wherein said plurality of explosive segments are arranged in a stacked configuration.

17. A warhead comprising:

a casing comprising a removable front portion;

a plurality of explosive segments positioned in said casing;

a plurality of spacers positioned in said casing and separating said plurality of explosive segments from each other; and a removable piston configured to be inserted inside said removable front portion of said casing, wherein said removable piston pushes against said plurality of explosive segments to create a continuous segment.

18. The warhead of claim 17, wherein said removable piston pushes against said plurality of explosive segments to close said plurality of spacers and move said warhead from an off position to an on position.

19. The warhead of claim 17, wherein said continuous segment is above an explosive failure thickness in said on position.

20. The warhead of claim 17, wherein said continuous segment is configured to detonate upon reaching said failure thickness.

* * * * *